US011198959B2

(12) United States Patent
Filipescu et al.

(10) Patent No.: US 11,198,959 B2
(45) Date of Patent: Dec. 14, 2021

(54) KNITTED SPORTS ARTICLE

(71) Applicant: adidas AG, Herzogenaurach (DE)

(72) Inventors: Florin Filipescu, Nuremberg (DE); Ulisse Matthias Tanzini, Nuremberg (DE); Matthias Johannes Gabriel Schmitt, Nuremberg (DE)

(73) Assignee: adidas AG, Herzogenaurach (DE)

( * ) Notice: Subject to any disclaimer, the term of this patent is extended or adjusted under 35 U.S.C. 154(b) by 146 days.

(21) Appl. No.: 16/459,086

(22) Filed: Jul. 1, 2019

(65) Prior Publication Data

US 2020/0046060 A1 Feb. 13, 2020

(30) Foreign Application Priority Data

Aug. 7, 2018 (DE) ..... 10 2018 213 242.9

(51) Int. Cl.

| | |
|---|---|
| ***D04B 7/32*** | (2006.01) |
| ***A43B 1/04*** | (2006.01) |
| ***A43B 23/02*** | (2006.01) |
| ***D04B 1/22*** | (2006.01) |
| ***D04B 1/24*** | (2006.01) |

(52) U.S. Cl.

CPC ..... *D04B 7/32* (2013.01); *A43B 1/04* (2013.01); *A43B 23/0205* (2013.01); *A43B 23/025* (2013.01); *D04B 1/22* (2013.01); *D04B 1/24* (2013.01)

(58) Field of Classification Search

CPC ... D04B 1/22; D04B 1/24; D04B 1/26; D04B 1/225; D04B 7/32; D04B 7/30; D04B 9/42; D04B 9/44; A43B 1/04

See application file for complete search history.

(56) References Cited

U.S. PATENT DOCUMENTS

| | | | | |
|---|---|---|---|---|
| 2,314,098 | A | 3/1943 | McDonald | |
| 5,836,177 | A * | 11/1998 | Okuno | D04B 37/02 66/64 |
| 5,946,944 | A | 9/1999 | Osborne | |
| 7,738,991 | B2 * | 6/2010 | Klumpp | D04B 1/26 700/141 |
| 9,439,475 | B2 * | 9/2016 | Ikenaka | D04B 1/106 |
| 9,549,591 | B2 * | 1/2017 | Uchikawa | A43B 23/0245 |
| 9,611,571 | B2 * | 4/2017 | Ikenaka | A43B 1/04 |
| 9,920,461 | B2 * | 3/2018 | Aristizabal | A43B 15/00 |

(Continued)

FOREIGN PATENT DOCUMENTS

| | | |
|---|---|---|
| EP | 0 105 773 A1 | 4/1984 |
| EP | 3 037 012 A1 | 6/2016 |

(Continued)

OTHER PUBLICATIONS

Extended European Search Report issued in European Patent Application No. 19190455.6, dated Nov. 22, 2019, 7 pages.

*Primary Examiner* — Danny Worrell
(74) *Attorney, Agent, or Firm* — Sterne, Kessler, Goldstein & Fox P.L.L.C.

(57) ABSTRACT

A shoe upper that includes a tubular knitted element. The tubular knitted element of the shoe upper includes an integrally-formed aperture. The aperture is formed by casting-off or binding-off at least one stitch, and the aperture includes at least a first width. The tubular knitted element includes an opening on at least one end of the tubular knitted element.

17 Claims, 9 Drawing Sheets

(56) References Cited

U.S. PATENT DOCUMENTS

| | | | | |
|---|---|---|---|---|
| 2015/0342261 | A1 | 12/2015 | Boucher et al. | |
| 2016/0143394 | A1 | 5/2016 | Ikenaka | |
| 2016/0213097 | A1* | 7/2016 | Uchikawa | A43B 23/0245 |
| 2017/0049187 | A1* | 2/2017 | Aristizabal | A43B 23/0245 |
| 2017/0311681 | A1 | 11/2017 | Kuo et al. | |
| 2018/0146736 | A1* | 5/2018 | Koyabu | D04B 1/24 |
| 2018/0184755 | A1* | 7/2018 | Yumiba | A43B 9/02 |
| 2018/0199668 | A1* | 7/2018 | Yumiba | D04B 7/30 |
| 2018/0317593 | A1* | 11/2018 | Dealey | D04B 1/24 |

FOREIGN PATENT DOCUMENTS

| | | | |
|---|---|---|---|
| EP | 2 922 435 | B1 | 11/2016 |
| EP | 3 338 585 | A1 | 6/2018 |
| JP | 2011-017097 | A | 1/2011 |

* cited by examiner

KNITTED SPORTS ARTICLE

TECHNICAL FIELD

The present invention relates to an improved sports article and methods for production of the same.

PRIOR ART

An article of footwear usually includes two primary elements, an upper and a sole element. Knitting is frequently used for producing textiles for shoe uppers. Knitted uppers may offer great comfort, flexibility, as well as breathability. However, present methods offer limited construction and design possibilities, thus limiting the comfort and functionality, for example the breathability, fit, and support, of existing knitted uppers. For example, presently a collar opening is cut into an upper after knitting, thus producing unnecessary waste and requiring an additional process step in the production.

EP 0105773 A1 relates to socks in general and in particular, to a two-ply sock of improved durability, comfort and construction for an athletic activity, such as jogging.

EP 2922435 B1 relates to an article of footwear having an upper and a sole structure that is secured to the upper. A knitted component of the upper is formed of a unitary knit construction and includes a sock portion and a tongue portion.

JP 2011017097 A1 concerns a method for forming an opening of tubular knitted fabric using a circular knitting machine.

U.S. Pat. No. 5,946,944 A concerns a seamless brassiere, and methods and a blank for making the brassiere are described. In particular, a tubular blank is circularly knit, and first and second walewise extending longitudinal openings are formed along opposite sides of the blank, to form torso and neck openings for the brassiere.

US 2015/0342261 A1 concerns a shoe comprising, from within the shoe, a first flexible textile layer forming a sock, and a reinforcing structure in which the textile layer is arranged and to which it is fixed by fixing means.

It is therefore an object underlying the present invention to provide a shoe upper with an improved level of comfort, fit, support, and breathability. It is also an object underlying the present invention to provide a more efficient method of producing the same.

SUMMARY OF THE INVENTION

This object is at least partially achieved by the teachings of the independent claims and in particular by a shoe upper comprising a tubular knitted element, wherein the tubular knitted element comprises an integrally-formed aperture, wherein the aperture is formed by casting-off or binding-off at least one stitch, and wherein the aperture comprises at least a first width.

A shoe in the present context may be any article of footwear, for example a running shoe, a football boot, a hiking boot, a tennis shoe, a golf shoe, a sandal, etc.

A tube in the present context may be essentially cylindrical but allowing for unintentional deviations, for example due to manufacturing imperfections, as well as intentional deviations from a mathematically perfect cylinder. Therefore, "tubular" in the context of the present invention is more understood in a topological sense. The diameter of the tubular knitted element may be engineered to vary along a longitudinal direction of the tubular knitted element depending, for example, on anatomic or athletic requirements. For example, the tubular knitted element may have a larger diameter in a forefoot portion than in a heel portion, etc.

An aperture is to be understood as an opening from which yarns are substantially absent. "Substantially absent" means that there may be some yarns, for example due to manufacturing imperfections or by wear on the knitted upper. The aperture may advantageously serve to facilitate inserting a foot into the shoe upper, or to provide regions of breathability or increased flexibility.

In casting-off, sometimes also called dropping-off, a newly-formed course of loops drops off their noses onto the knocking-over bits. This may be achieved as the needle bar moves away from the pressing-edge when the sinkers and dividers withdraw. In other words, the needles release a loop so that it hangs suspended by its head from the foot of a new loop whose head is still held in a hook of the needles. Casting-off may be performed on a circular knitting machine, for example a small circular knitting machine. Some knitting machines can be programmed directly for a drop-off, while others cannot. In the latter case, it is possible to overcome this problem by using an empty feeder. Therefore, cut-off waste is reduced further. After casting-off, the needles that performed the cast-off remain inactive, i.e. not knitting, in order to create the aperture. "Binding-off" is understood as any process that allows a stitch to be secured in order to prevent unravelling. Binding-off may be performed on a flat knitting machine. After binding-off, the needles that performed the bind-off remain inactive, i.e. not knitting, in order to create the aperture.

After casting-off, binding-off, the method may further comprise not knitting on a certain number of needles for a predetermined number of courses, during the knitting of the tubular knitted element.

An advantage of the shoe upper according to the present invention is that it can be produced easily, quickly, and efficiently. In particular, since the aperture is formed integrally during knitting, no additional step of cutting may be required. Therefore, waste is reduced and the method is simplified, compared to existing methods. A further advantage of the upper according to the present invention is that intricate structural designs may be implemented. For example, it is possible to create overlapping layers with differently styled apertures. Therefore, the upper is more functional than uppers known in the art.

Another advantage of the shoe upper according to the present invention is that the technique of cast-off or bind-off can also be advantageously used to replace time-consuming knitting processes that are used to seal off the edges of a finished knitted upper. Generally, the edges of a finished upper are closed or sealed to prevent the edges from fraying after knitting, for example, during manipulation of the uppers, washing, etc. Thereafter, the cutting process removes these edges from the upper by die-cutting. One such time-consuming knitting process of closing the edge of the knitted upper is called "narrowing." Narrowing involves moving the stitches to the inside of the fabric being knitted using the transfers. This way the width of the fabric gets smaller. Narrowing is time consuming because the machine is not knitting in that time, but transferring. Another time-consuming process for sealing the edge of the upper may be linking. Therefore, instead of carrying out narrowing or linking on the edges of the knitted upper, that is meant to be later cut and the cut edges thrown away as waste material, the edge of the upper can be quickly and partly secured by means of cast-off. This will save a substantial amount of knitting time per upper and also give an upper with a neat selvedge which does not fray.

The tubular knitted element may include an opening on at least one end of the tubular knitted element, and the aperture may not be joined with the opening. In other words, the aperture and the opening may be separated by knitted yarns of the tubular knitted element.

Therefore, the aperture may, for example, serve to provide additional ventilation, while the opening may be a separate collar opening. Thus, the functionality of the upper is improved.

The tubular knitted element may include an opening on at least one end of the tubular knitted element, and the aperture may be joined to the opening. Therefore, the aperture and the opening may form a large joint opening. In this way, such a large joint opening can be created without additional material waste and in a greater variety of shapes than would be possible with conventional knitting.

A width of the aperture may change essentially gradually. A width may be measured along a course direction. "Essentially gradually" means, in this context, that a width of the aperture changes by the width of less than 10 wales, and in some embodiments, less than 4 wales, or just one or two wales, from a first course to a subsequent second course. If there is more than one wale width in the shoe upper, an average wale width is to be considered for this purpose. It is generally perceived to be more comfortable if properties such as flexibility and support vary gradually, rather than abruptly, over the upper.

The aperture may further include at least a second width, wherein the first and second widths may be different. For example, the width of the aperture may change essentially gradually from the first width to the second width. The second width may be essentially zero, which is to be understood as less than one wale width. In this way, a greater variety of shapes may be provided in order to improve the functionality of the upper.

The tubular knitted element may include a first portion and a second portion, wherein the first portion may be folded into the second portion or the second portion may be at least partially folded over the first portion, thus forming an internal knitted portion and an external knitted portion. In other words, the internal knitted portion may be a first layer and the external portion may be a second layer, and the first layer and the second layer at least partially overlap. The term, "layer" is not to be confused with a double jersey, i.e., a double-layer construction. It should be noted, that it is not necessary for the first layer and the second layer to overlap completely.

This advantageously allows regions of reinforcement to be engineered by the folding of the second portion into the first portion. This can be done by selectively only reinforcing part of the shoe upper without creating sizeable cut-off waste.

The aperture may be arranged at least on one of the first or the second portion, and the aperture may at least partially overlap with the second or the first portion, respectively. For example, the second layer may be at least partially visible through the aperture, which is arranged in the first layer, or vice versa. This allows a region of increased breathability to be engineered without significantly reducing the overall level of support provided by the shoe upper since the regions surrounding the aperture continue to provide support.

The internal knitted portion and the external knitted portion may be connected. This may further increase the stability of the shoe upper. For example, the first and the second layer may be connected by a technique known as linking in an essentially seamless manner. Alternatively, the first and the second layer may be connected by sewing, gluing, by means of a melt yarn (and at least partially melting the meltable yarn), a meltable sheet (and at least partially melting the meltable sheet), a chemical sheet, such as an adhesive sheet or tape, or by any other suitable means.

The shoe upper may include at least one melt yarn having a low-temperature meltable composition. The meltable composition may include a thermoplastic polymer with a melting point of 200° C. or lower, 150° C. or lower, or 100° C. or lower. The latter may also be referred to as a low melt yarn and may be advantageous as it allows lower temperatures to be applied for melting and thus reduces the risk of damage to the knit. Melting the meltable component allows an easy and secure way of consolidating the structure of the tubular knitted element. For example, this may allow for connection of the first layer and the second layer.

The melt yarn may include a sheath and a core, and the sheath may include the low-temperature meltable composition. This type of melt yarn may be advantageous as it continues to provide good tensile strength even after melting.

The melt yarn may at least be arranged adjacent to the aperture. This arrangement is advantageous, as melting the meltable yarn helps to prevent fraying or unravelling around the aperture.

The shoe upper may include at least one elastic yarn. An elastic yarn is to be understood within its common meaning in the field of textile engineering. An elastic yarn allows the upper to conform well to the shape of a foot.

The elastic yarn may include elastane. Elastane is advantageously highly elastic, yet durable.

The elastic yarn may be at least arranged adjacent to the aperture. An elastic yarn may help to prevent fraying or unravelling around the aperture.

At least a portion of an edge of the aperture may include one or more courses of knitted loops of elastic yarn and/or melt yarn. These one or more courses of elastic yarn and/or melt yarn may be dropped-off or bound-off. This arrangement is advantageous, as melting the meltable yarn helps to prevent fraying or unravelling around the aperture. Additionally, or alternatively, the elastic yarn may help to prevent fraying or unravelling around the aperture. This may be one or more complete courses, which is particularly simple to implement.

In particular, the one or more courses of knitted loops may be partially knitted along the edges of the aperture. Just before the cast-off, or bind-off, extra courses may be knitted with only the needles that will cast-off or bind-off. In other words, during a knitting sequence, knitting may be isolated to selected area(s), while the remaining stitches may be held and may not be knit. All held stitches may be knitted at a later stage. By holding stitches, the number of courses changes within the fabric length. This can cause the direction of the knitting to change and/or form a three-dimensional (3D) area in the fabric. This further helps to prevent fraying.

The first portion may include a first yarn and the second portion may include a second yarn, the first yarn has a first yarn thickness and the second yarn has a second yarn thickness, and the first yarn thickness is smaller than the second yarn thickness.

Yarn thickness is closely related to the perceived "softness" of the fabric. The finer the yarn, the softer the fabric. For example, the internal knitted portion may be in contact with the foot of a wearer, or at least with a sock worn by the wearer. It may thus be preferable to use a softer yarn for the internal knitted portion. For example, the first yarn thickness may be less than 25 μm, less than 20 μm, or less than 15 μm. However, finer yarn may also be less abrasion-resistant, and therefore it may be preferable that the second yarn thickness is greater than the first yarn thickness. The term "yarn thickness" may also relate to fiber thickness for fiber yarns, such as natural yarns.

The first portion may include a first type of yarn and the second portion may include a second type of yarn, wherein the first type of yarn and the second type of yarn may be different. A type of yarn is determined by its intrinsic properties, such as, for example, the material that it comprises, or its structure, e.g., sheath-core, vs. single strand, etc., but not merely by its thickness, the number of plies or strands, or the dernier- or Tex-value. For example, two yarns that both comprise polyester but that have a different thickness and/or number of plies are considered to be a same type. By using a different type of yarn, it is further possible to enhance the advantageous effects of selectively creating stability or flexibility and breathability.

The tubular knitted element may be knitted by a circular knitting machine, for example a small circular knitting machine. A circular knitting machine allows high production speeds.

The tubular knitted element may be knitted by a flat knitting machine. Flat knitting allows structures to be constructed that cannot be constructed with circular knitting.

The invention further concerns a shoe including a shoe upper according to the present invention. The shoe may further include a sole element. The sole element may include a midsole having preferred cushioning properties and an outsole to facilitate a preferred level of grip on the ground and protection of the foot. The shoe upper confers the advantageous properties described herein to the shoe according to the present invention.

The invention further concerns a method of producing a shoe upper including: knitting a tubular knitted element; creating an integrally-formed aperture comprising at least a first width in the tubular knitted element by casting-off or binding-off at least one stitch.

The terminology and advantages of the present method have already been described with reference to the shoe upper.

Knitting the tubular knitted element may include knitting an opening on at least one end of the tubular knitted element that is not joined with the aperture. The advantages thereof have already been described with reference to the shoe upper.

Knitting the tubular knitted element may include knitting an opening on at least one end of the tubular knitted element joined with the aperture. The advantages thereof have already been described with reference to the shoe upper.

The method may further include changing a width of the aperture essentially gradually. The advantages thereof have already been described with reference to the shoe upper.

Creating the integrally-formed aperture further includes shaping the aperture so that it includes at least a second width which is different from the first width. For example, the width of the aperture may change essentially gradually from the first width to the second width. The second width may be essentially zero, which is to be understood as less than one wale width. The advantages thereof have already been described with reference to the shoe upper.

The tubular knitted element may include a first portion and a second portion, wherein creating an aperture in the tubular knitted element may include integrally forming the aperture in the first portion and/or in the second portion, and folding the first portion into the second portion or folding the second portion at least partially over the first portion, thus forming an internal knitted portion and an external knitted portion. The advantages thereof have already been described with reference to the shoe upper.

The method may include integrally forming the aperture in at least one of the first or the second portion and arranging the tubular knitted element such that the aperture at least partially overlaps with the second portion or the first portion, respectively. The advantages thereof have already been described with reference to the shoe upper.

The method may further include connecting the internal knitted portion and the external knitted portion. The details and advantages thereof have already been described with reference to the shoe upper.

The shoe upper may include at least one melt yarn, comprising a low-temperature meltable composition, wherein the melt yarn is arranged at least adjacent to the aperture. The details and advantages thereof have already been described with reference to the shoe upper.

The shoe upper may include at least one elastic yarn, wherein the elastic yarn is arranged at least adjacent to the aperture. The details and advantages thereof have already been described with reference to the shoe upper.

The method may further include knitting at least a portion of an edge of the aperture using one or more courses of knitted loops of elastic yarn and/or melt yarn. These one or more courses of elastic yarn and/or melt yarn may be dropped-off or bound-off. The details and advantages thereof have already been described with reference to the shoe upper.

In particular, the one or more courses of knitted loops may be partially knitted along the edges of the aperture. The details and advantages thereof have already been described with reference to the shoe upper.

Knitting may include using a first yarn in the first portion and a second yarn in the second portion, wherein the first yarn has a first yarn thickness and the second yarn has a second yarn thickness, and wherein the first yarn thickness may be smaller than the second yarn thickness. The advantage thereof has already been described herein with reference to the shoe upper.

Knitting may include using a first type of yarn for the first portion and a second type of yarn for the second portion, wherein the first and second types of yarn may be different. The details and advantages thereof have already been described with reference to the shoe upper.

The invention further concerns a method of producing a shoe that includes: producing a shoe upper as described herein, and attaching a sole element to the shoe upper. The details and advantages thereof have already been described with reference to the shoe.

SHORT DESCRIPTION OF THE FIGURES

In the following, exemplary embodiments of the invention are described with reference to the figures. The figures show:

Figure 7A:
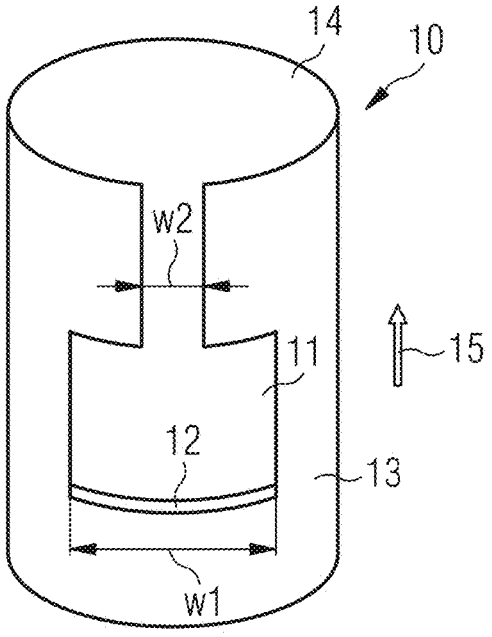
Figure 7B:
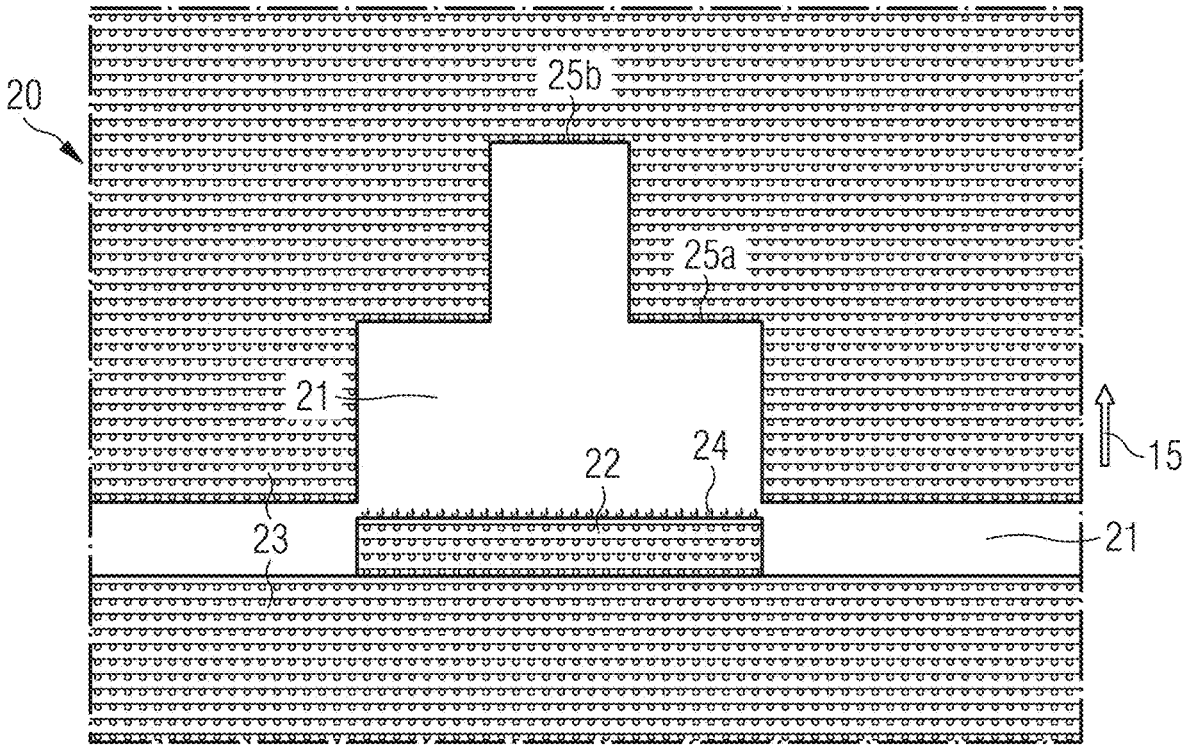
Figure 7C:
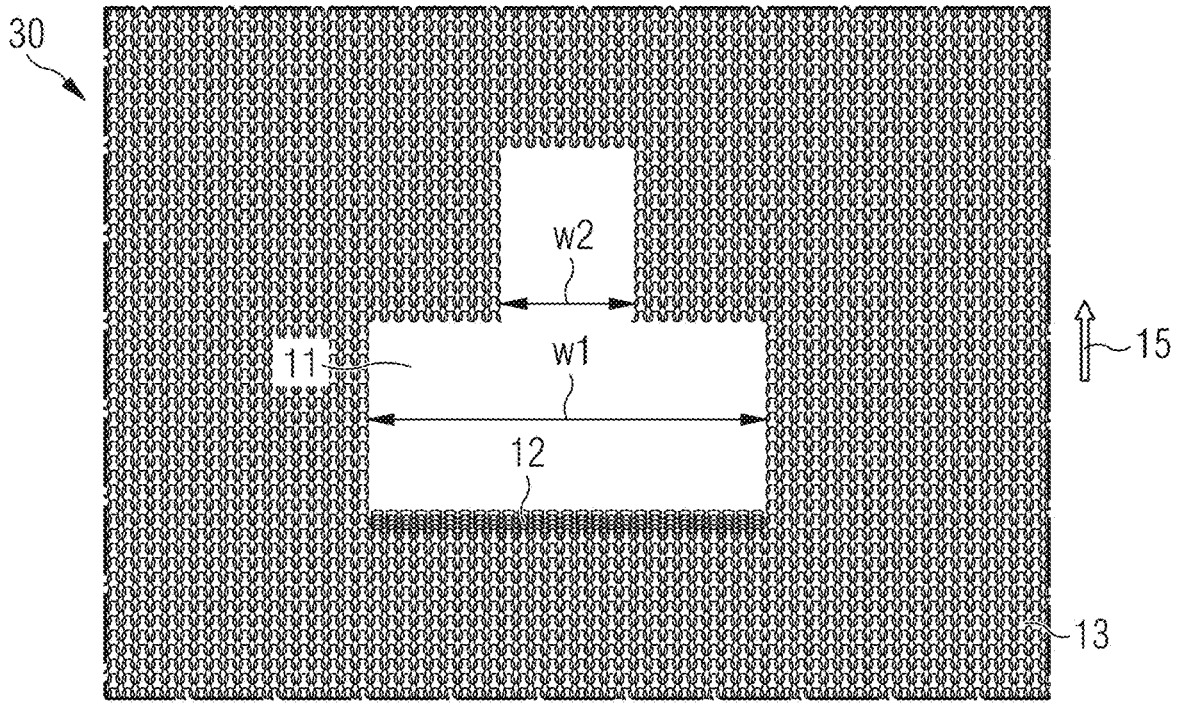

FIGS. 7A-C show an exemplary tubular knitted element for a shoe upper according to the present invention (FIG. 7A), the corresponding exemplary knitting scheme (FIG. 7B), and an exemplary portion of a tubular knitted element (FIG. 7C).

Figure 8A:
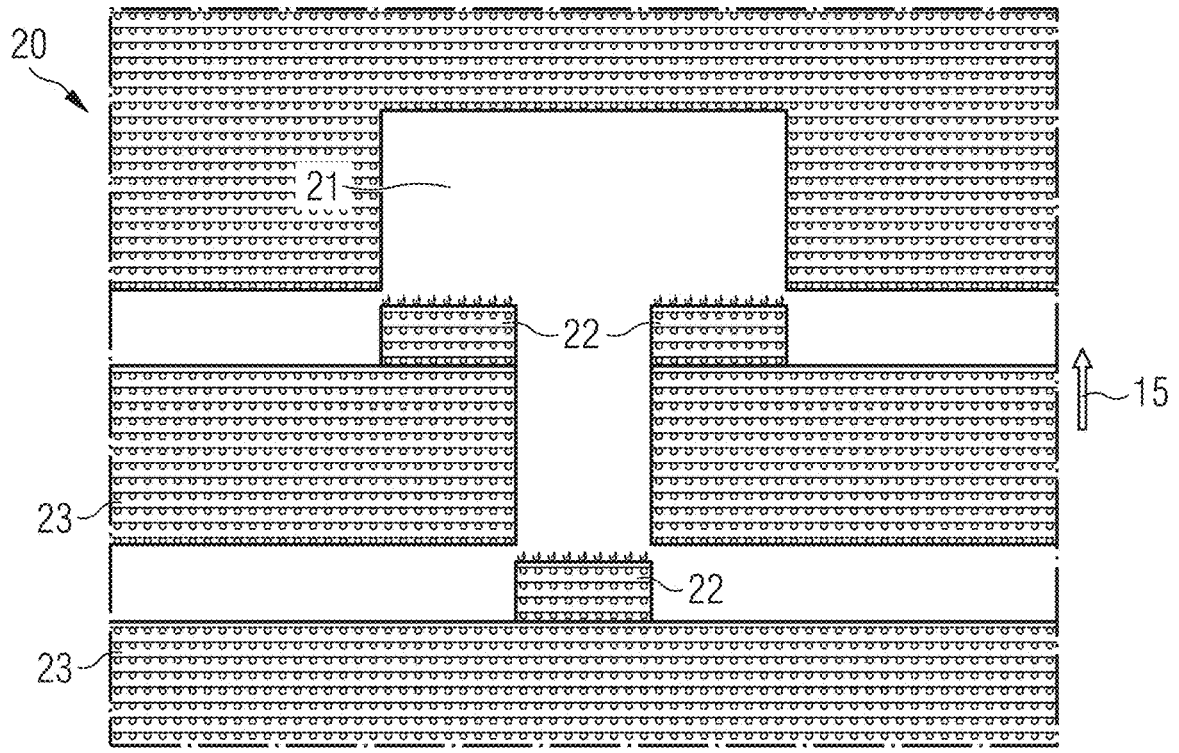
Figure 8B:
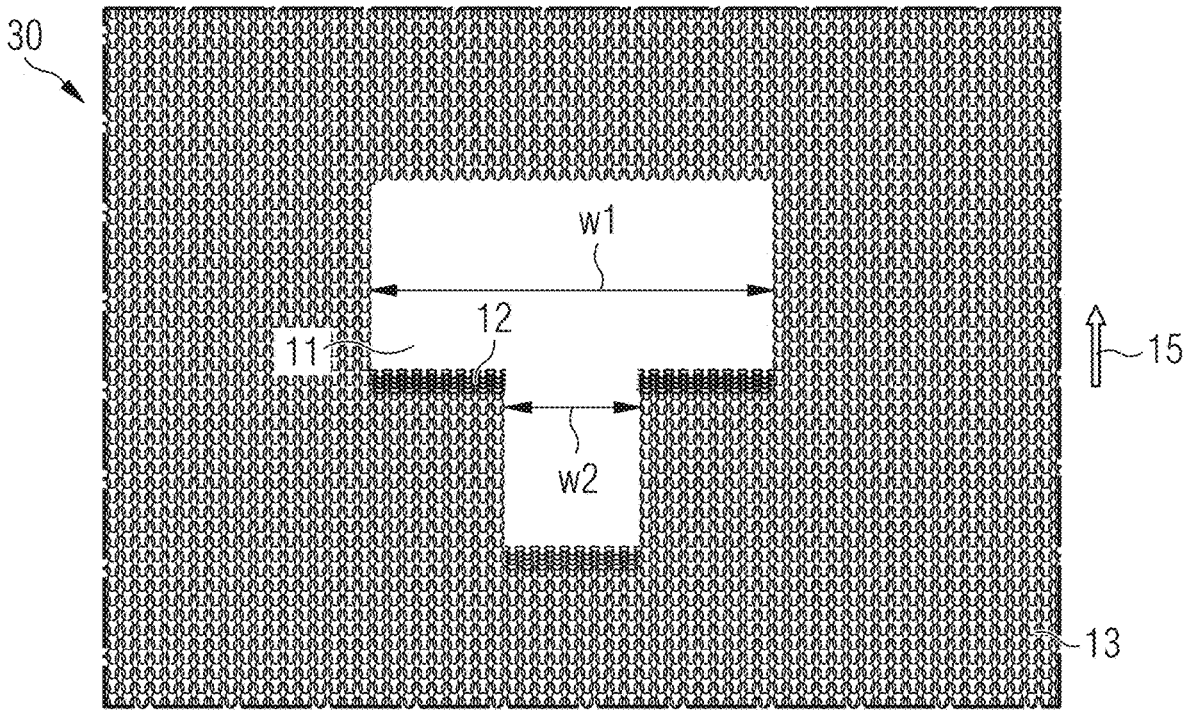

FIGS. 8A-B show an exemplary knitting scheme (FIG. 8A), and an exemplary portion of a tubular knitted element (FIG. 8B).

Figure 9:
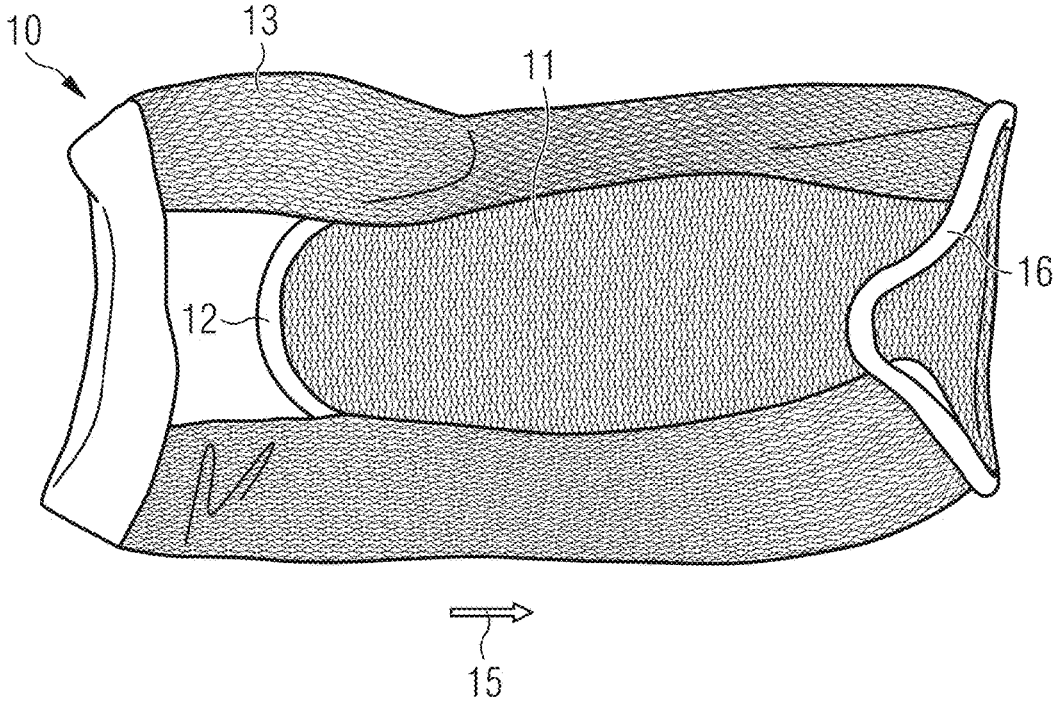

FIG. 9 shows an exemplary tubular knitted element for a shoe upper according to the present invention.

Figure 10A:
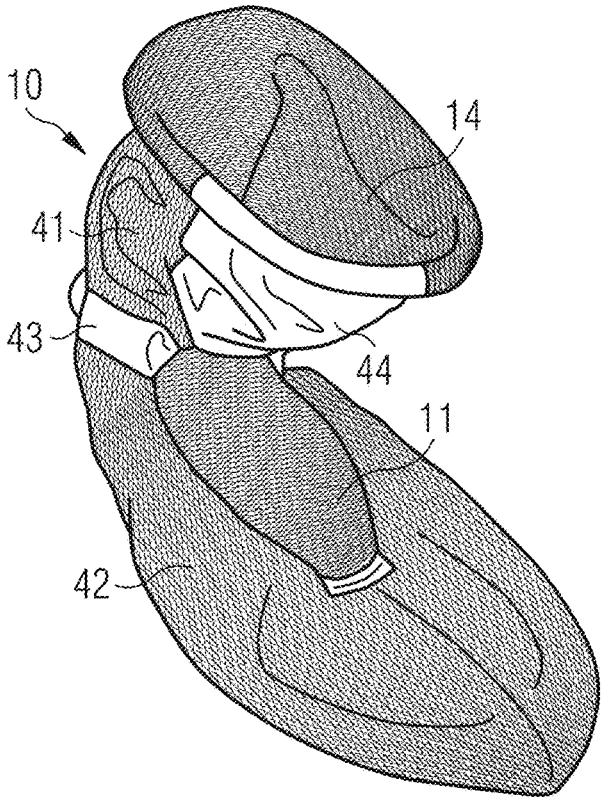
Figure 10B:
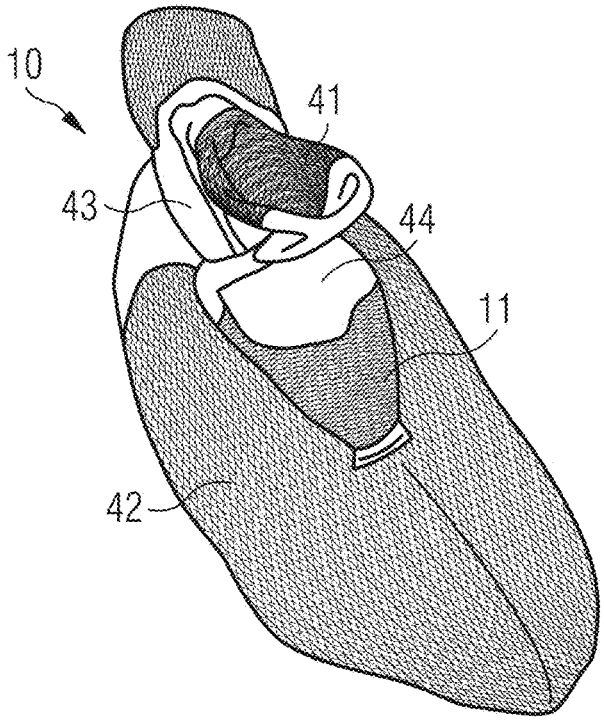
Figure 10C:
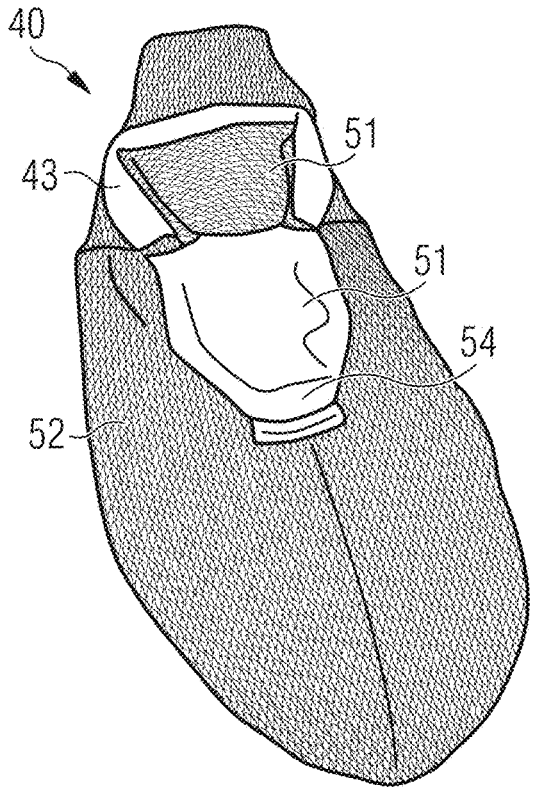

FIGS. 10A-C show an exemplary tubular knitted element for a shoe upper according to the present invention (FIGS. 10A and 10B) and the resulting shoe upper (FIG. 10C).

Figure 11:
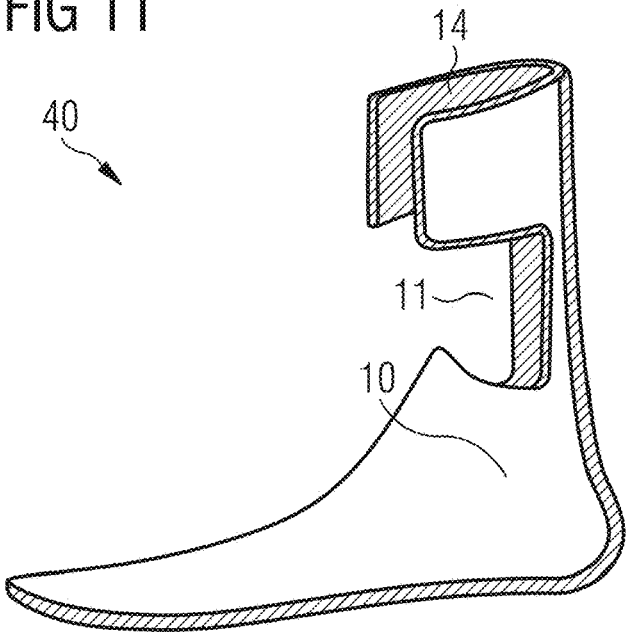

FIG. 11 shows an exemplary upper according to the present invention.

Figure 12:
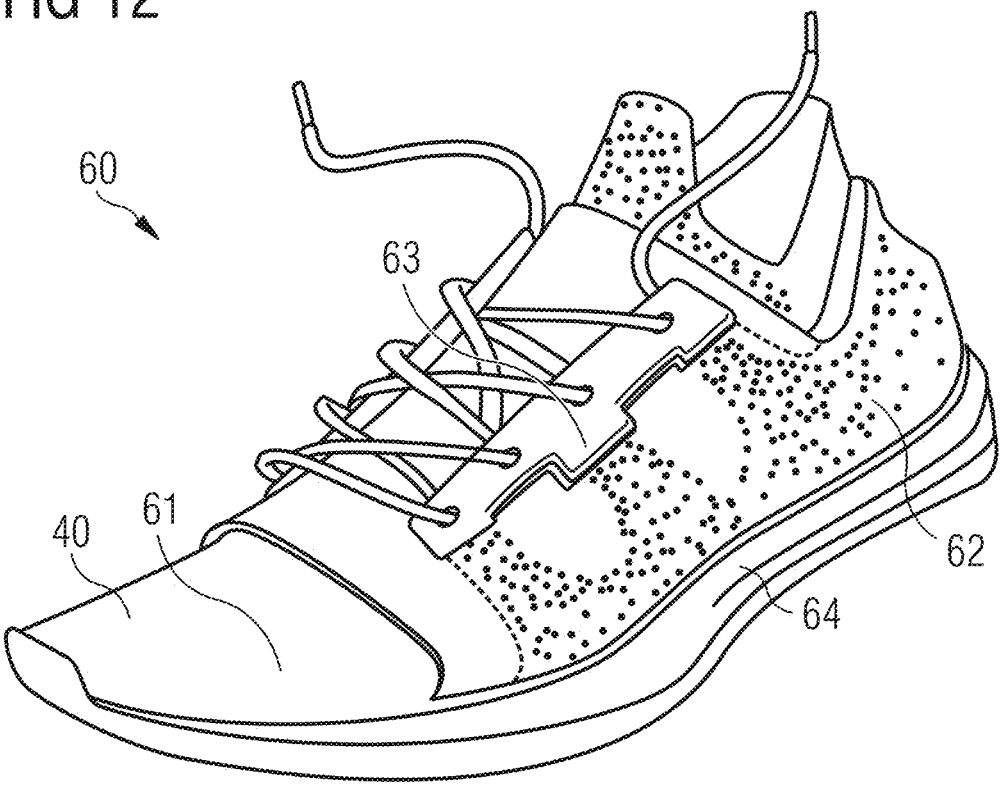

FIG. 12 shows an exemplary shoe according to the present invention.

DETAILED DESCRIPTION OF PREFERRED EMBODIMENTS

In the following, only some possible embodiments of the invention are described in detail. It is to be understood that these exemplary embodiments can be modified in a number of ways and combined with each other whenever compatible and that certain features may be omitted in so far as they appear dispensable.

Figure 1:
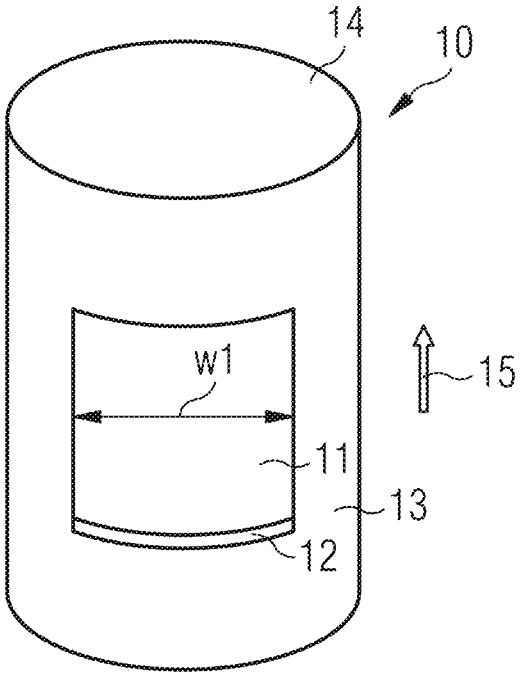
FIG. 1 shows an exemplary tubular knitted element for a shoe upper according to the present invention.

FIG. 1 shows an exemplary tubular knitted element 10 for a shoe upper according to the present invention. The tubular knitted element 10 includes an integrally-formed aperture 11, formed by dropping several stitches off a set of needles and wherein the set of needles remain inactive, i.e. do not knit, for a certain number of knitting rows (courses). The last courses prior to the drop-off are indicated with reference numeral 12. The knitting direction 15 is from bottom to top. The tubular knitted element 10 includes a knit 13, surrounding the aperture 11 and an opening 14 at an end. In this example, the tubular knitted element 10 is knitted on a small circular knitting machine. However, it is also possible to knit the tubular knitted element 10 on a flat knitting machine.

Figure 2:
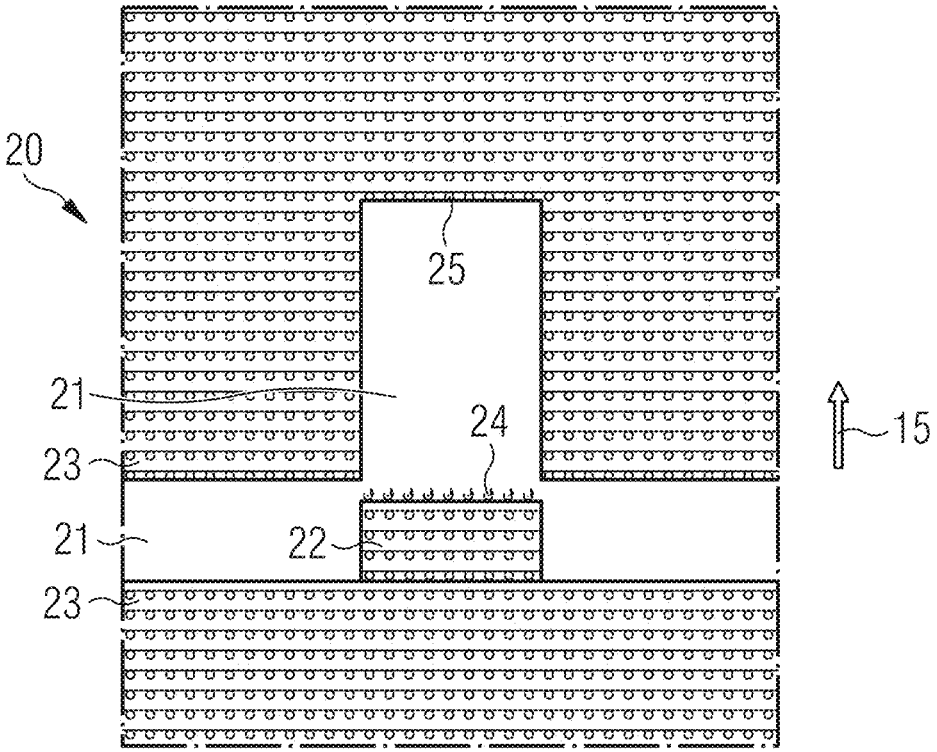
FIG. 2 shows an exemplary circularly-knitted knitting scheme for the tubular knitted element shown in FIG. 1 according to the present invention.

FIG. 2 shows an exemplary knitting schematic 20 for producing the tubular knitted element 10 shown in FIG. 1. Needles are knitting in the areas indicated with reference numeral 23 and 22 but are not knitting in the area indicated with reference numeral 21. The last courses knitted prior to the drop-off are indicated with reference numeral 22. The knitting direction 15 is from bottom to top. The last courses are knitted only on those needles that will undergo the drop-off, i.e., the other needles are not knitting at that time, and help prevent fraying. During this time, the rest of the needles are inactive, holding the existing stitches. This is also called partial knitting herein. These last courses are knitted with a blend of elastic yarn and melt yarn. Reference numeral 24 indicates the drop-off, also known as cast-off, beyond which the exemplary nine adjacent needles indicated do not knit until they start knitting again at reference numeral 25.

Figure 3:
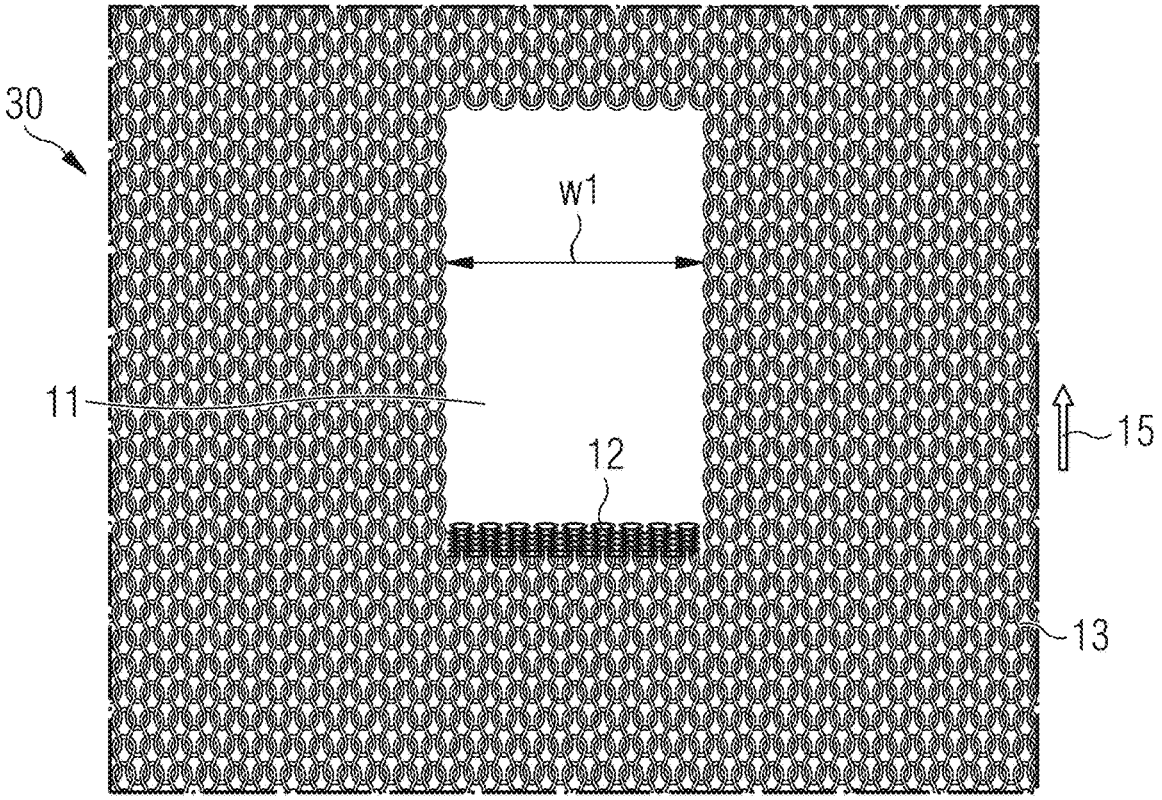
FIG. 3 shows an exemplary portion of a tubular knitted element, knitted by the knitting scheme shown in FIG. 2.

FIG. 3 shows an exemplary portion 30 of a tubular knitted element 10, knitted by the knitting scheme shown in FIG. 2. The exemplary portion comprises an aperture 11 formed by the drop-off described with respect to the previous figure for nine adjacent needles. The knitting direction 15 is from bottom to top. The aperture 11 therefore has a first width w1 approximately equal to the width of nine adjacent wales. In this example, the width of the aperture 11 is constant, i.e. does not change essentially gradually. In particular, the width equals the first width w1. The last courses prior to drop-off are indicated with reference numeral 12 and the knit 13 surrounding the aperture 11 is indicated with reference numeral 13.

Figure 4:
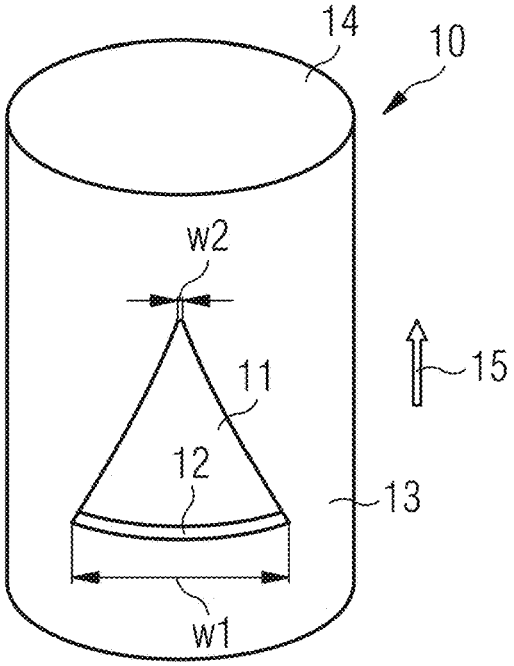
FIG. 4 shows an exemplary tubular knitted element for a shoe upper according to the present invention.

FIG. 4 shows another exemplary tubular knitted element 10 for a shoe upper according to the present invention. The tubular knitted element 10 comprises an aperture 11, formed by dropping several stitches. The knitting direction 15 is from bottom to top. In this example, a width of the aperture 11 changes essentially gradually. In particular, the width changes from a first width w1 to a second width w2, wherein the second width is zero. The last courses prior to the drop-off are indicated with reference numeral 12. The tubular knitted element 10 comprises a knit 13, surrounding the aperture 11 and an opening 14 at an end.

Figure 5:
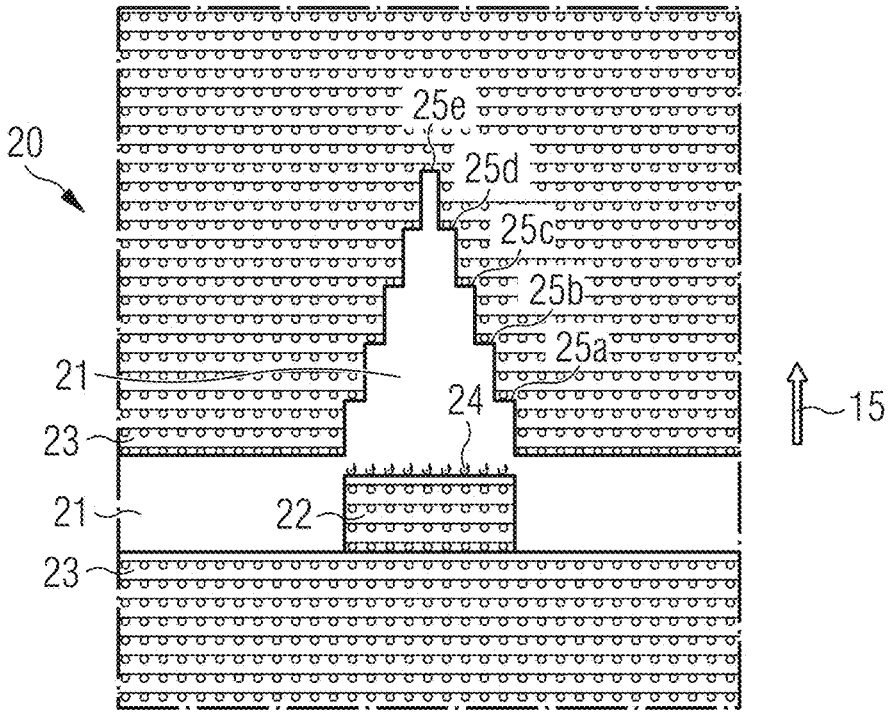
FIG. 5 shows an exemplary circularly-knitted knitting scheme for the tubular knitted element shown in FIG. 4 according to the present invention.

FIG. 5 shows an exemplary knitting schematic 20 for producing the tubular knitted element 10 shown in FIG. 4. Needles are knitting in the areas indicated with reference numeral 23 and 22 but are not knitting in the area indicated with reference numeral 21. The knitting direction 15 is from bottom to top. The last courses knitted prior to the drop-off are indicated with reference numeral 22. The last courses are knitted only on those needles that will undergo the drop-off, i.e., the other needles are not knitting at that time, and help prevent fraying. During this time, the rest of the needles are inactive, holding the existing stitches. This is also called partial knitting herein. These last courses are knitting with a blend of elastic yarn and melt yarn. Reference numeral 24 indicates the drop-off, also known as cast-off, beyond which 9 adjacent needles initially do not knit. In this example, needles resume knitting essentially gradually, thereby creating an aperture 11 with an essentially gradually-varying width, that is reduced by the width of two wales every four courses. At point 25*a*, two needles at the edges of the aperture 11 resume knitting, at each of the points 25*b*, 25*c*, 25*d*, two further needles at the edges of the aperture 11 resume knitting. Finally, at point 25*e*, all needles resume knitting.

Figure 6:
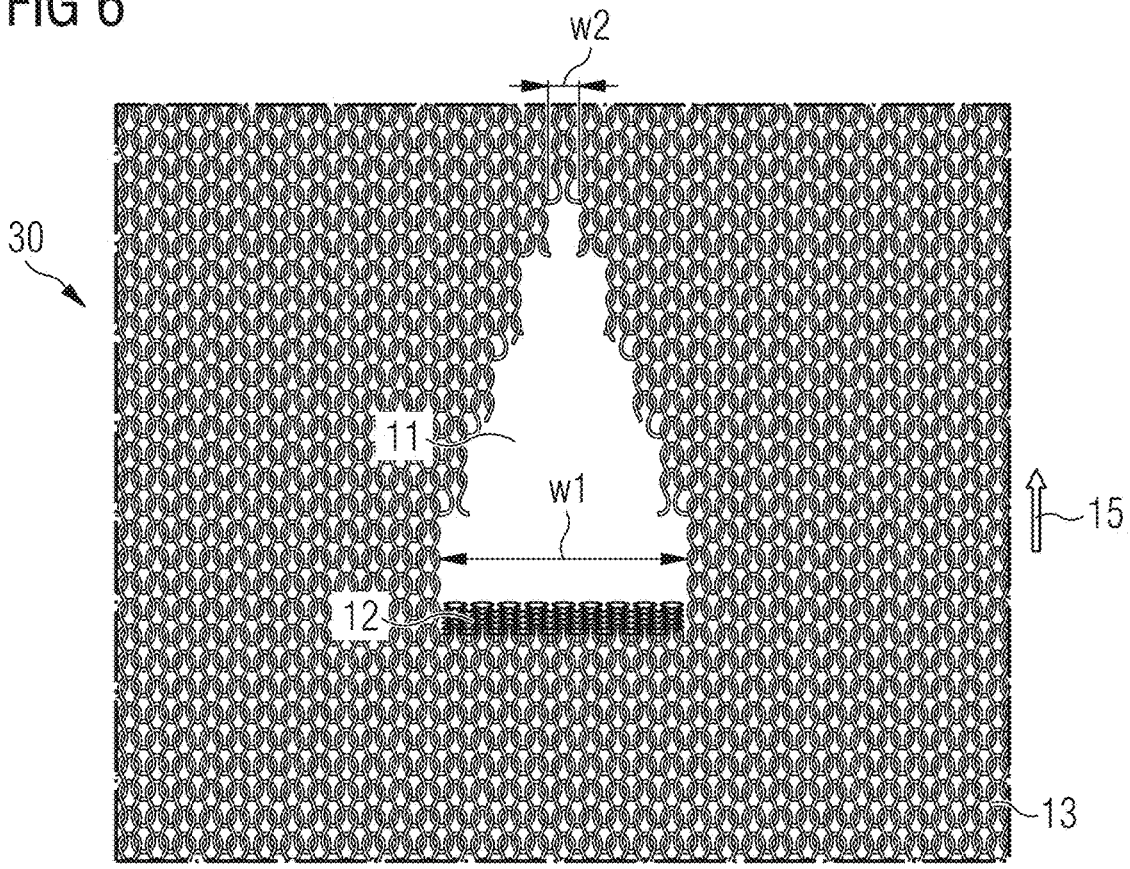
FIG. 6 shows an exemplary portion of a tubular knitted element, knitted by the knitting scheme shown in FIG. 5.

FIG. 6 shows an exemplary portion 30 of a tubular knitted element 10, knitted by the knitting scheme shown in FIG. 5. The exemplary portion comprises an aperture 11 formed by the drop-off described with respect to the previous figure. The knitting direction 15 is from bottom to top. The aperture 11 therefore has a first width w1 approximately equal to the width of nine adjacent wales. In this example, the width of the aperture 11 is reduced essentially gradually by the width of two wales every four courses from the first width w1 to the second width w2, wherein the second width is essentially the width of one wale. The last courses prior to drop-off are indicated with reference numeral 12 and the knit 13 surrounding the aperture 11 is indicated with reference numeral 13.

FIG. 7A shows another exemplary tubular knitted element 10 for a shoe upper according to the present invention. The tubular knitted element 10 comprises an aperture 11, wherein the aperture 11 has a first width w1 and a second width w2. The last courses prior to the drop-off are indicated with reference numeral 12. The knitting direction 15 is from bottom to top. The tubular knitted element 10 comprises a knit 13, surrounding the aperture 11 and an opening 14 at an end.

FIG. 7B shows an exemplary knitting schematic 20 for producing the tubular knitted element 10 shown in FIG. 7A.

Needles are knitting in the areas indicated with reference numeral 23 and 22 but are not knitting in the area indicated with reference numeral 21. The last courses knitted prior to the drop-off are indicated with reference numeral 22. The last courses are knitted only on those needles that will undergo the drop-off, i.e. the other needles are not knitting at that time, and help prevent fraying. These last courses are knitting with a blend of elastic yarn and melt yarn. Reference numeral 24 indicates the drop-off, also known as cast-off, beyond which 9 adjacent needles initially do not knit. In this example, some of the needles resume knitting at point 25*a*. Therefore, the aperture 11 of the formed tubular knitted element 10 comprises a first width w1 and a second width w2. The knitting direction 15 is from bottom to top.

FIG. 7C shows an exemplary portion 30 of a tubular knitted element 10, knitted by the knitting scheme shown in FIG. 7B. The exemplary portion includes an aperture 11 formed by the drop-off described with respect to FIG. 7B. The aperture 11 has a first width w1 and a second width w2. The last courses prior to drop-off are indicated with reference numeral 12 and the knit 13 surrounding the aperture 11 is indicated with reference numeral 13. The knitting direction 15 is from bottom to top.

FIG. 8A shows an exemplary knitting schematic 20 for producing the portion 30 of the tubular knitted element 10 shown in FIG. 8B. Needles are knitting in the areas indicated with reference numeral 23 and 22 but are not knitting in the area indicated with reference numeral 21. The last courses knitted prior to the drop-off are indicated with reference numeral 22. The last courses are knitted only on those needles that will undergo the drop-off, i.e. the other needles are not knitting at that time, and help prevent fraying. These last courses are knitting with a blend of elastic yarn and melt yarn. Reference numeral 24 indicates the drop-off, also known as cast-off. In this example, there are three separate cast-offs, of which two occur on the same course. Therefore, the aperture 11 of the formed tubular knitted element 10 has a first width w1 and a second width w2 (as shown in FIG. 8B). The knitting direction 15 is from bottom to top.

FIG. 8B shows an exemplary portion 30 of a tubular knitted element 10, knitted by the knitting scheme shown in FIG. 8A. The exemplary portion comprises an aperture 11 formed by the drop-off described with respect to FIG. 8A. The aperture 11 comprises a first width w1 and a second width w2. The last courses prior to drop-off are indicated with reference numeral 12 and the knit 13 surrounding the aperture 11 is indicated with reference numeral 13. The knitting direction 15 is from bottom to top.

FIG. 9 shows an exemplary tubular knitted element for a shoe upper according to the present invention. The tubular knitted element 10 comprises an aperture 11, formed by dropping several stitches. The last courses prior to the drop-off are indicated with reference numeral 12, after which the needles which dropped the stitches are inactive, thus forming the aperture 11. The needles which dropped the stitches then resume knitting at the restarting position 16. The knitting direction 15 is from left to right. The tubular knitted element 10 comprises a knit 13, surrounding the aperture 11 and an opening 14 at both ends.

FIG. 10A shows another example of a tubular knitted element 10 for a shoe upper 40 according to the present invention, including a first portion 41 and a second portion 42 separated at a fold line 43, as well as aperture 11. In this example, the tubular knitted element 10 is open at opening 14. The tubular knitted element 10 also includes a region 44 for the tongue of the shoe upper 40.

FIG. 10B illustrates an intermediate step of a method by which the first portion 41 is folded into the second portion 42 about the fold line 43.

FIG. 10C shows a shoe upper 40 resulting from the folding operation illustrated in FIG. 10B. In this example, the inner knitted portion 51 and the outer knitted portion 52 do not overlap completely. In particular, the tongue 54, which forms part of the inner knitted portion 51, includes only a single layer. In this example, the tubular knitted element 10 includes an opening 14 at one end of the tubular knitted element 10, and, the aperture 11 is not joined to the opening.

FIG. 11 shows a shoe upper 40 according to the present invention. The shoe upper 40 includes a tubular knitted element 10, wherein the tubular knitted element 10 includes an integrally-formed aperture 11, wherein the aperture 11 is formed by casting-off or binding-off at least one stitch, and wherein the aperture 11 has at least a first width.

In this example, the tubular knitted element 10 includes an opening 14 at one end of the tubular knitted element 10, and, the aperture 11 is joined to the opening 14. The shoe upper therefore provides a great amount of torsional freedom, which may be advantageous in sports that require a quick change of direction.

FIG. 12 shows an exemplary shoe 60 according to one of the preceding embodiments. The shoe 60 also includes a sole element 64. The sole element 64 includes a midsole having preferred cushioning properties and an outsole to facilitate a preferred level of grip on the ground and protection of the foot. The shoe upper 40 includes a single-layer portion 61, which offers good flexibility and breathability as well as a double-layer portion 62 which offers improved support. The shoe upper 40 also includes an element 63 comprising polyurethane to further reinforce the region around the lace eyelets.

Some embodiments described herein relate to a shoe upper having a tubular knitted element, wherein the tubular knitted element comprises an integrally-formed aperture, and wherein the aperture is formed by casting-off or binding-off at least one stitch, and wherein the aperture comprises at least a first width.

In any of the various embodiments described herein, a width of the aperture may change essentially gradually.

In any of the various embodiments described herein, the internal knitted portion and the external knitted portion may be connected.

In any of the various embodiments described herein, the shoe upper may include at least one melt yarn having a low-temperature meltable composition. In some embodiments, the melt yarn may at least be arranged adjacent to the aperture.

In any of the various embodiments described herein, the shoe upper may include at least one elastic yarn.

In any of the various embodiments described herein, the tubular knitted element may be knitted by a small circular knitting machine.

In any of the various embodiments described herein, the tubular knitted element may be knitted by a flat knitting machine.

Some embodiments described herein relate to a method of producing a shoe upper that includes knitting a tubular knitted element, and creating an integrally-formed aperture, comprising at least a first width, in the tubular knitted element by casting-off or binding-off at least one stitch.

In any of the various embodiments described herein, the method of producing a shoe upper may further include changing a width of the aperture essentially gradually.

In any of the various embodiments described herein, a width of the aperture changes essentially gradually from a first width to a second width.

In any of the various embodiments described herein, the method of producing a shoe upper may further include knitting at least a portion of an edge of the aperture using one or more courses of knitted loops of elastic yarn and/or melt yarn.

In any of the various embodiments described herein, knitting may include using a first yarn in the first portion and a second yarn in the second portion, wherein the first yarn has a first yarn thickness and the second yarn has a second yarn thickness, and wherein the first yarn thickness is smaller than the second yarn thickness.

In any of the various embodiments described herein, knitting may include using a first type of yarn for the first portion and a second type of yarn for the second portion, wherein the first and second types of yarn are different.

REFERENCE SIGNS

10: tubular knitted element
11: aperture
12: last rows of courses
13: knit
14: opening
15: knitting direction
16: restarting point
w1: first width
20: knitting schematic
21: region in which needles are not knitting
22: last rows of courses
23: wales and courses
24: stitch drop-off region
25: drop-off needles resume knitting
30: portion of knitted tube
w2: second width
40: upper
41: first portion
42: second portion
43: fold line
44: region for tongue
51: inner knitted portion
52: outer knitted portion
53: melt yarn
54: tongue
55: elastic yarn
60: shoe
61: single-layer portion
62: double-layer portion
63: element
64: sole element

What is claimed is:

1. A shoe upper, comprising a tubular knitted element comprising an opening at an end of the tubular knitted element, wherein the tubular knitted element comprises an integrally-formed aperture;

wherein the aperture is formed by casting-off or binding-off at least one stitch, wherein the aperture comprises at least a first width, and wherein the aperture is not joined with the opening at the end of the tubular knitted element.

2. The shoe upper according to claim 1, wherein the aperture further comprises at least a second width, wherein the first and second widths are different.

3. The shoe upper according to claim 2, wherein a width of the aperture changes essentially gradually from the first width to the second width.

4. The shoe upper of claim 1, wherein the tubular knitted element comprises a first portion and a second portion, wherein the first portion is folded into the second portion or the second portion is at least partially folded over the first portion such that an internal knitted portion and an external knitted portion are formed, and wherein the aperture is arranged at least on one of the first or the second portions, and the aperture is arranged over the second portion or the first portion.

5. The shoe upper according to claim 1, wherein the shoe upper comprises at least one elastic yarn, and wherein the elastic yarn is at least arranged adjacent to the aperture.

6. The shoe upper according to claim 1, wherein at least a portion of an edge of the aperture comprises one or more courses of knitted loops of elastic yarn and/or melt yarn.

7. The shoe upper according to claim 4, wherein the first portion comprises a first yarn and the second portion comprises a second yarn, wherein the first yarn has a first yarn thickness and the second yarn has a second yarn thickness, and wherein the first yarn thickness is smaller than the second yarn thickness.

8. The shoe upper according to claim 4, wherein the first portion comprises a first type of yarn and the second portion comprises a second type of yarn, wherein the first type of yarn and the second type of yarn are different.

9. A shoe comprising a shoe upper according to claim 1.

10. A method of producing a shoe upper using a knitting machine having needles, comprising:

knitting a tubular knitted element;

creating an integrally-formed aperture, comprising at least a first width, in the tubular knitted element by:

stopping knitting with a first plurality of the needles such that the first plurality of the needles are inactive while continuing knitting one or more courses with a second plurality of the needles;

casting-off or binding-off at least one stitch on the second plurality of the needles while the first plurality of the needles are inactive; and resuming knitting with the first plurality of the needles.

11. The method according to claim 10, wherein creating the integrally-formed aperture further comprises shaping the aperture so that it comprises at least a second width which is different from the first width.

12. The method according to claim 10, wherein the tubular knitted element comprises a first portion and a second portion, wherein creating an aperture in the tubular knitted element comprises integrally forming the aperture in the first portion and/or in the second portion, and folding the first portion into the second portion or folding the second portion at least partially over the first portion so as to form an internal knitted portion and an external knitted portion, and wherein the method further comprises integrally forming the aperture in at least one of the first or the second portions, and arranging the tubular knitted element such that the aperture at least partially overlaps with the second or the first portions, respectively.

13. The method according to claim 12, further comprising connecting the internal knitted portion and the external knitted portion.

14. The method according to claim 10, wherein the shoe upper comprises at least one melt yarn comprising a low-temperature meltable composition, wherein the melt yarn is arranged at least adjacent to the aperture.

15. The method according to claim 10, wherein the shoe upper comprises at least one elastic yarn, wherein the elastic yarn is arranged at least adjacent to the aperture.

16. A method of producing a shoe, comprising:

producing a shoe upper according to claim 10; and attaching a sole element to the shoe upper.

17. A shoe upper, comprising a tubular knitted element, comprising:

a first tubular portion having an integrally formed tongue region;

a second tubular portion attached to the first tubular portion at a fold line;

an aperture integrally formed with the tubular knitted element by casting-off or binding-off at least one stitch of the tubular knitted element; and an opening at an end of the first tubular portion, wherein the aperture is not joined with the opening at the end of the first tubular portion, wherein the first tubular portion of the tubular knitted element is folded into the second tubular portion at the fold line, such that the tongue region of the first tubular portion is arranged within the aperture.

* * * * *